United States Patent [19]

Lee

[11] Patent Number: 4,799,619

[45] Date of Patent: Jan. 24, 1989

[54] DRINKING FLUIDS CARTON

[76] Inventor: Ki-Seok Lee, 77-19, Yukchon-Dong, Eunpyung-ku, Seoul, Rep. of Korea

[21] Appl. No.: 54,530

[22] Filed: May 27, 1987

[30] Foreign Application Priority Data

Mar. 25, 1987 [KR] Rep. of Korea ..... 87-3789[U]

[51] Int. Cl.[4] ..... B65D 5/74

[52] U.S. Cl. ..... 229/125.42; 206/621.3; 206/621.4

[58] Field of Search ..... 229/125.42, 103.1; 206/621.3, 621.4; 222/527–530, 541, 572

[56] References Cited

U.S. PATENT DOCUMENTS

| | | | |
|---|---|---|---|
| 2,488,323 | 11/1949 | Parker | 229/125.42 |
| 2,954,901 | 10/1960 | Winstead | 222/528 |
| 3,003,673 | 10/1961 | Clark et al. | 206/621.3 |
| 3,057,531 | 10/1962 | Preen | 229/125.42 |
| 3,269,644 | 8/1966 | Bump | 222/572 |
| 3,642,189 | 2/1972 | Widenback | 229/125.42 |

FOREIGN PATENT DOCUMENTS

| | | | |
|---|---|---|---|
| 1437100 | 3/1966 | France | 206/621.3 |

*Primary Examiner*—Stephen Marcus
*Assistant Examiner*—Gary E. Elkins
*Attorney, Agent, or Firm*—Ladas & Parry

[57] ABSTRACT

A hexahedral drinking fluids carton comprising an upwardly tapered outflow opening extending from a bottom portion of a side wall of the carton and communicating with an access opening at a bottom portion of a diamond-shaped bendable guide part. At the top portion of the guide part, an outflow mouth can be folded flat against a top wall of the carton and interposed between a cover, applied to the carton, and the top wall so as to seal the carton. A removable protective covering portion of the cover is positioned above the outflow mouth so that the outflow mouth can be exposed when the protective covering portion is removed from the cover.

4 Claims, 3 Drawing Sheets

DRINKING FLUIDS CARTON

FIELD OF THE INVENTION

The present invention relates to a drinking fluids carton having an integral straw-like portion. More particularly, the invention relates to a carton having an upwardly tapered outflow opening in a side wall of the carton and a diamond-shaped bendable guide part that has an access opening at a bottom portion that communicates with the outflow opening and an outflow mouth opening, at the top portion of the guide part, for contact with the user's mouth.

BACKGROUND OF THE INVENTION

In the art of personal fluids containers for juices, milk, water, or beverages, there are generally two different types of carton designs used in the marketplace. The first type of carton consist of a fully sealed carton with a weakened portion somewhere on its surface. A drinking straw, which is usually provided with such containers, is wrapped in a breakable cover which is fixed to the carton. To drink out of the container, the user must first remove the straw from the wrapping and then push the straw against the weakened part on the carton to access the fluid in the container. Some of the problems with these cartons is that the straw can become jarred from the carton, it can be difficult to break through the weakened part, or, since the weakened part and the straw are usually quite slender so as to save space, the flow of the fluid out of the container is restricted.

The second type of carton is one usually used for milk or inward to seal the carton. Although these type of cartons allow for a generally unrestricted fluid flow, they can be difficult to inward to seal the carton. Although these types of cartons allow for a generally unrestricted fluid flow, they can be difficult to open when the flaps, which make up the gable-like structure, become soggy and/or deformed. In addition, when the carton falls over with the spout open, the fluid inside the container is not blocked from pouring out. Another disadvantage to this type of container is that the pouring spout is at the top of the container, therefore, the sediment at the bottom of the container, in the case of fruit juices, has difficulty pouring out.

SUMMARY OF THE INVENTION

An object of the invention is to provide a compact hexahedron carton, without projections when sealed, that has an integral straw-like portion that allows for a relatively unrestricted flow, as compared to the straws of the prior art, while also having the ability to seal the container when the carton rolls over onto the straw-like portion. Another object of the invention is to provide a carton that can easily access the sediment at the bottom of a juice container.

To achieve these objectives, the invention comprises an upwardly tapered outflow opening extending from a bottom portion of a side wall of the carton and communicating with an access opening at a bottom portion of a diamond-shaped bendable guide part. At the top portion of the guide part, an outflow mouth can be folded flat against a top wall of the carton so that a cover, with a removable protective covering portion above the outflow Other objects, features, and advantages of the invention will be apparent from the following detailed description of the preferred embodiment, with reference to the accompanying drawings.

DETAILED DESCRIPTION OF THE PREFERRED EMBODIMENT

Figure 1:
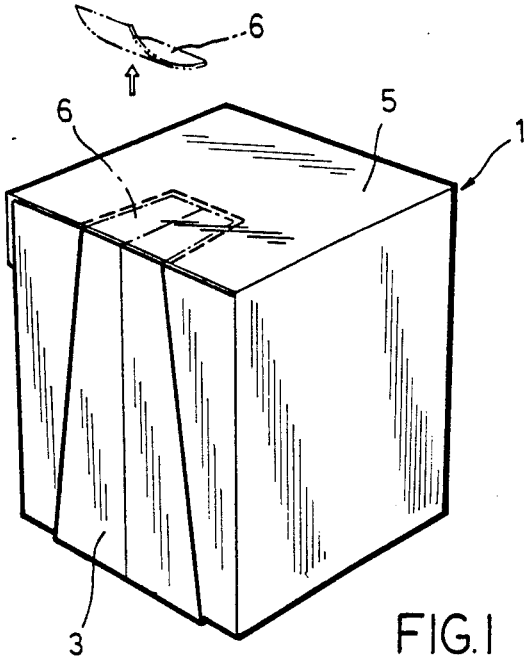
FIG. 1 is a perspective view showing a drinking fluids carton and a guide part in a sealed configuration.
Figure 2:
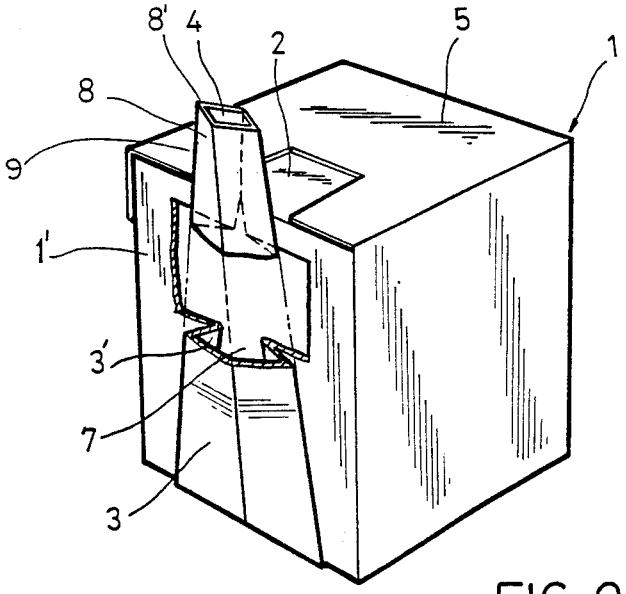
FIG. 2 is a perspective view showing the drinking fluids carton in use with the outflow mouth part extending from the carton.

In the preferred embodiment, as illustrated in FIG. 1 and FIG. 2, an upwardly tapered, diamond-shaped and bendable guide part (3) is formed adjacent to one side wall (1') of a hexahedral drinking fluids carton and has two exterior (8) and two interior (8') contiguous surfaces. The guide part also comprises an access opening (3') at a lower portion that communicates with an upwardly tapered outflow opening (7), extending from a bottom wall (1'). In addition, a portion of the interior surfaces (8') are fixed to the side wall (1') up to outflow mouth part (4). Moreover, to seal the carton for shipping and storage, outflow mouth part (4) is folded flat over top wall (2) of the carton so as to be interposed between top wall (2) and covering (5) when covering (5) is applied to the carton. A removable protective covering portion (6), of covering (5), is positioned above the folded outflow mouth so that removable protective covering portion (6) can be torn-off cover (5) to expose outflow mouth part (4). Once outflow mouth part (4) is exposed, the diamond shape can be formed when an edge (9), between the contiguous surfaces (8, 8'), is pressed.

Figure 3:
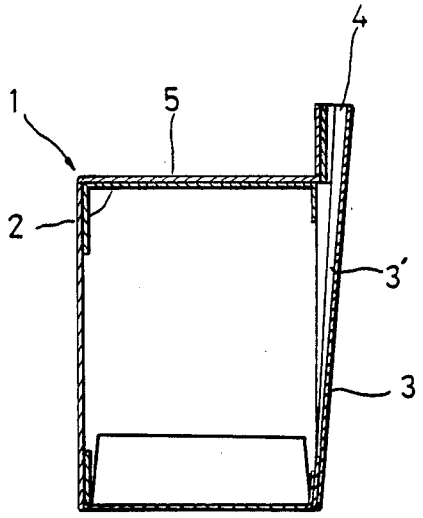
FIG. 3 is a sectional view of the drinking fluids carton and the guide part.

In FIG. 3, a side view of the invention is shown which illustrates the positioning of cover (5) and top wall (2). Moreover, the communication between outflow mouth part (4) and access opening (3') is shown.

Figure 4:
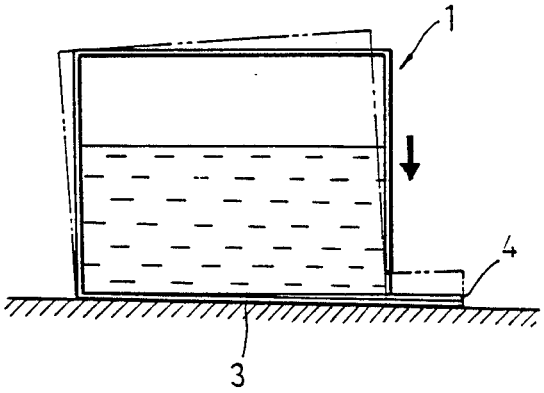
FIG. 4 is a side view showing how the drinking fluids carton of the present invention works when it falls down on its side.

As shown in FIG. 4, when the carton rolls onto the side having the guide part (3) formed thereon, the weight of the fluid collapses the diamond-shape of guide part (3) so that the carton becomes sealed. Another advantage of the placement of the guide part (3) and outflow opening (7) is that the fluid is drawn out of the bottom of the carton through a relative large opening (i.e., access opening (3') and outflow opening (7)), as compared to the usual straw supplied with prior art cartons, so that the fluid flow is less restricted and the sediments at the bottom of a fruit drink can be ingested.

Figure 5:
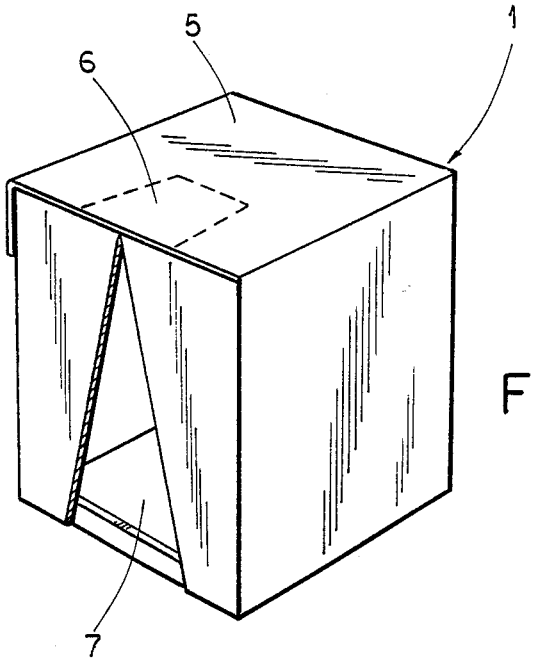
FIG. 5 is a perspective view of the drinking fluids carton showing only the outflow opening.

FIG. 5 shows the upwardly tapered outflow opening (7) in greater detail with guide part (3) removed from the carton. As illustrated in FIG. 5, outflow hole (7) becomes wider towards the bottom wall. It should be noted that the upwardly tapered outflow opening (7) does not have to extend to the top wall. FIG. 5 also shows the outline of removable protective covering portion (6) of cover (5).

Figure 6:
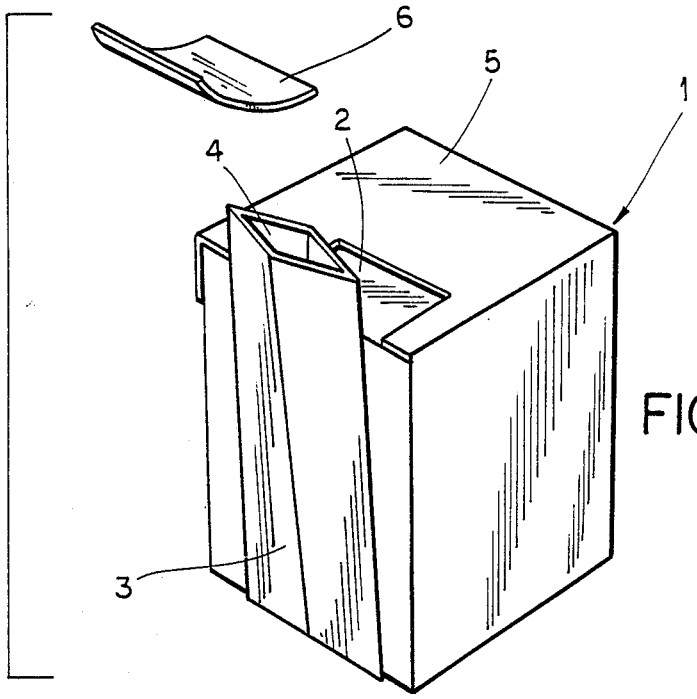
FIG. 6 is another embodiment of the drinking fluids carton of the present invention wherein the guide part does not taper upwards.

Another embodiment of the present invention is shown in FIG. 6. Specifically, guide part (3) in FIG. 6 does not taper whereas outflow opening (7), not shown in FIG. 6, still does taper.

The present invention as described hereinabove enables a multitude of cartons (1) to be stored in a small space by placing one upon another, prevents the drinking fluids within the carton from outflowing when it falls down in the direction of guide part (3), enables the easy access to sediment on the bottom of the carton and is also beneficial to public health by preventing foreign matter from sticking to outflow mouth (4) since the outflow mouth is covered by removable protective covering portion (6).

What is claimed is:

1. A hexahedral drinking fluids carton comprising:

a tapered outflow opening extending upwardly from a bottom portion of a side wall of the carton; and an upwardly tapered diamond-shaped bendable guide part with two interior and two exterior contiguous surfaces, having an outflow mouth part at an upper portion of the guide part, said upper portion extending above a top wall of the carton and an access opening at a bottom portion of the guide part, said guide part is formed adjacent to the side wall of the carton with a portion of the interior surfaces fixed to the side wall such that said guide port seals the outflow opening, wherein the access opening communicates with the outflow opening, and wherein the outflow mouth part can be folded flat against the top wall of the carton and sealed by a removable protective covering portion applied above the outflow mouth part.

2. A drinking carton according to claim 1, wherein the outflow mouth part is interposed between said top wall of the carton and a cover applied to the carton, and wherein the cover contains the removable protective covering portion.

3. A hexahedral drinking fluid carton comprising:

a tapered outflow opening extending upwardly from a bottom portion of a side wall of the carton; and a diamond-shaped bendable guide part with two interior and two exterior contiguous surfaces, having an outflow mouth part at an upper portion of the guide part, said upper portion extending above a top wall of the carton and an access opening at a bottom portion of the guide part, said guide part is formed adjacent to the side wall of the carton with a portion of the interior surfaces fixed to the side wall such that said guide part seals the outflow opening, wherein the access opening communicates with the outflow opening, and wherein the outflow mouth part can be folded flat against the top wall of the carton and sealed by a removable protective covering portion applied above the outflow mouth part.

4. A drinking fluid carton according to claim 3, wherein the outflow mouth part is interposed between said top wall of the carton and a cover applied to the carton, and wherein the cover contains the removable protective covering portion.

* * * * *